US012565369B2

(12) United States Patent
Nehus et al.

(10) Patent No.: US 12,565,369 B2
(45) Date of Patent: Mar. 3, 2026

(54) EASY PEEL POUCH

(71) Applicant: MARS, INCORPORATED, McLean, VA (US)

(72) Inventors: Uwe Nehus, Verden (DE); Stefan Eberhardt, Verden (DE); Gytis Kulbickas, Verden (DE)

(73) Assignee: MARS, INCORPORATED, McLean, VA (US)

( * ) Notice: Subject to any disclaimer, the term of this patent is extended or adjusted under 35 U.S.C. 154(b) by 168 days.

(21) Appl. No.: 16/099,727

(22) PCT Filed: Jun. 15, 2017

(86) PCT No.: PCT/US2017/037647
§ 371 (c)(1),
(2) Date: Nov. 8, 2018

(87) PCT Pub. No.: WO2017/218755
PCT Pub. Date: Dec. 21, 2017

(65) Prior Publication Data

US 2019/0185239 A1 Jun. 20, 2019

(30) Foreign Application Priority Data

Jun. 15, 2016 (GB) ..... 1610432

(51) Int. Cl.
*B65D 75/58* (2006.01)
*B65D 33/16* (2006.01)
(Continued)

(52) U.S. Cl.
CPC ..... *B65D 75/5855* (2013.01); *B65D 33/16* (2013.01); *B65D 33/25* (2013.01);
(Continued)

(58) Field of Classification Search
None
See application file for complete search history.

(56) References Cited

U.S. PATENT DOCUMENTS 2,998,880 A * 9/1961 John ..... B65D 75/5855 206/363
3,163,288 A * 12/1964 Arvidsson ..... A61B 17/06133 206/63.3

(Continued)

FOREIGN PATENT DOCUMENTS

CH 701906 A1 * 3/2011 ..... B65D 75/5822
CN 101437737 A 5/2009

(Continued)

OTHER PUBLICATIONS

Gu, Daphne. "The Effects of Water Activity, Particle Size Distribution and Free Fat Content on Flowability of Grated and Dried Parmesan Cheese." https://mro.massey.ac.nz/bitstream/handle/10179/12344/01_front.pdf?sequence=1 (Year: 2000).*

(Continued)

*Primary Examiner* — Viren A Thakur
(74) *Attorney, Agent, or Firm* — Baker Botts L.L.P.

(57) ABSTRACT

Embodiments described herein provide for a flexible package including one or more permanent seals and an easy-peel seal. The easy-peel seal an elongated shape that defines a convex portion which projects away from the enclosed space. When opening the package by pulling apart the opposing walls thereof as by grasping and pulling a plurality of flaps, the effective peeling force increases at least 5 N as the package is opened.

15 Claims, 7 Drawing Sheets

(51) Int. Cl.

| | |
|---|---|
| ***B65D 33/25*** | (2006.01) |
| ***B65D 33/34*** | (2006.01) |
| ***B65D 75/32*** | (2006.01) |
| ***B65D 81/32*** | (2006.01) |

(52) U.S. Cl.
CPC ..... *B65D 33/34* (2013.01); *B65D 75/322* (2013.01); *B65D 75/58* (2013.01); *B65D 81/32* (2013.01)

(56) References Cited

U.S. PATENT DOCUMENTS 3,342,326 A * 9/1967 Zackheim ..... B65D 75/30 222/211
3,740,237 A 6/1973 Grindrod et al.
3,890,448 A * 6/1975 Ito ..... B65D 75/32 426/126
3,983,994 A * 10/1976 Wyslotsky ..... B65D 81/3266 426/115
4,183,434 A 1/1980 Watt
4,198,972 A * 4/1980 Herb ..... B65D 53/08 604/408
4,279,344 A * 7/1981 Holloway, Jr. ..... A61L 2/26 229/123.1
4,498,591 A * 2/1985 Smith, II ..... B65D 33/007 383/906
4,871,091 A 10/1989 Preziosi
D319,780 S 9/1991 Laaki
5,077,064 A * 12/1991 Hustad ..... B65D 33/2533 426/123
5,459,978 A 10/1995 Weiss et al.
5,538,345 A * 7/1996 Gotoh ..... B65D 75/5855 383/210
5,971,971 A 10/1999 Saint-Ramon et al.
6,270,255 B1 8/2001 Kaufman et al.
6,296,389 B1 * 10/2001 Yamamoto ..... B65D 75/5855 206/484
6,409,386 B1 6/2002 Trani
6,485,177 B2 11/2002 Bell et al.
6,568,533 B1 * 5/2003 Tanaka ..... B65D 75/30 206/484
7,240,790 B2 7/2007 Wendel et al.
D584,610 S 1/2009 Eberhardt
7,972,318 B2 7/2011 Nijs et al.
D688,565 S 8/2013 Boehmke et al.
D688,566 S 8/2013 Boehmke et al.
D692,315 S 10/2013 Keukens et al.
D692,316 S 10/2013 Boehmke
D742,245 S 11/2015 Monforton
D781,718 S 3/2017 Loyd
D793,865 S 8/2017 Bentley
D796,967 S 9/2017 Abang
D805,919 S 12/2017 Ross
D811,238 S 2/2018 Van Den Berg
D830,850 S 10/2018 Tan
D840,835 S 2/2019 Tan
D850,927 S 6/2019 Cobler
D864,755 S 10/2019 Eberhardt
D922,881 S 6/2021 Haskins
2002/0126921 A1 * 9/2002 Bell ..... B65D 75/008 383/104
2004/0052906 A1 * 3/2004 Hernandez ..... A23K 50/45 426/89
2005/0089250 A1 * 4/2005 Laske ..... B65D 75/30 383/88
2007/0104395 A1 * 5/2007 Kinigakis ..... B31B 50/81 383/61.1
2007/0119862 A1 * 5/2007 Backes ..... B65D 81/3266 222/107
2007/0151885 A1 * 7/2007 Loyd ..... A61F 13/55185 206/440
2008/0004594 A1 * 1/2008 Pahlberg ..... A61J 1/2093 604/410
2008/0031555 A1 * 2/2008 Roberts ..... B32B 5/142 383/210
2008/0240628 A1 * 10/2008 VanLoocke ..... B65B 29/10 383/210
2009/0097786 A1 * 4/2009 Goglio ..... B65D 75/008 383/211
2009/0161995 A1 * 6/2009 Henderson ..... B65D 75/5855 383/210
2010/0272868 A1 * 10/2010 Krysty ..... B65D 81/3266 426/120
2010/0307384 A1 * 12/2010 Urushidani ..... B65D 75/5855 108/42
2011/0177213 A1 * 7/2011 Muller ..... B65D 75/5855 426/123
2011/0308981 A1 * 12/2011 Dacey ..... A61B 50/30 53/469
2012/0145569 A1 * 6/2012 Chew ..... B32B 27/40 206/205
2013/0048636 A1 2/2013 Mack
2013/0308882 A1 * 11/2013 Fogle ..... B65D 75/5855 53/450
2014/0360900 A1 * 12/2014 Mizuoka ..... B65D 27/36 206/305
2015/0147583 A1 * 5/2015 Bao ..... B32B 27/20 428/516
2015/0284144 A1 * 10/2015 Dytchkowskyj ... B65D 75/5877 383/119
2015/0329259 A1 * 11/2015 Varbanov ..... B65D 25/16 53/469
2019/0009950 A1 * 1/2019 Farstad ..... B65D 33/01

FOREIGN PATENT DOCUMENTS

CN 202863949 U 4/2013
EM 000166673 7/2004
EM 004049472-0001 6/2017
EM 004049472-0002 6/2017
EM 004049472-0003 6/2017
EM 004049472-0004 6/2017
EM 004049472-0005 6/2017
EM 004049472-0006 6/2017
EM 004049472-0007 6/2017
EM 004049472-0008 6/2017
EP 343629 A1 * 11/1989
EP 1059243 A2 * 12/2000 ..... B65D 75/20
EP 2746048 A1 6/2014
JP 60-032251 10/1989
JP 2013049474 A * 3/2013
JP 1484578 10/2013
JP 2015113170 A * 6/2015
JP 2016096737 A 5/2016
WO 2017218755 A1 12/2017

OTHER PUBLICATIONS

YorkieTalk.com, 2010 https://www.yorkietalk.com/forums/yorkie-health-diet/210988-my-yorki-will-only-eat-dry-dog-food-shredded-cheese.html (Year: 2010).*
Novasina. "The influence of water activity (aw) in meat products." 2008 http://www.equinlab.com/pdf_/Influencia%20de%20la%20actividad%20de%20agua%20(aw)%20en%20productos%20carnicos.pdf (Year: 2008).*
"Courteous Canine" Feb. 13, 2014 web.archive.org/web/20150923010030/http://www.courteouscanine.com/tampa-dog-trainer-how-do-you-cook-your-dogs/ (Year: 2014).*
Marcos, A. et al. "Water Activity and Chemical Composition of Cheese." 1981 J Dairy Sci 64:622-626 (Year: 1981).*
International Search Report mailed Sep. 6, 2017 in International Application No. PCT/US17/37647, 28 pgs.
Monthly Food Packaging Magazine, No. 1, vol. 57, (Jan. 1, 2013), p. 13.

* cited by examiner

EASY PEEL POUCH

CROSS REFERENCE TO RELATED APPLICATIONS

This application claims the benefit of United Kingdom Patent Application Serial No. 1610432.5, filed on Jun. 15, 2016, which is incorporated herein by reference in its entirety.

BACKGROUND

Pouches are becoming a popular packaging option for many different materials. In situations in which it is desirable to have a large opening for accessing the contents of the pouch, prior art solutions typically require that the pouch be cut or torn open to create a break in the walls of the pouch. In order for the cut or tear to provide direct access to the contents, the break in the walls must extend through the enclosed space. This can create an issue in that breaking the walls that form the enclosed space can cause the contents in the enclosed space to unintentionally escape during opening.

One pouch design exists in which a linear top seal is designed to be hand-peeled apart. This pouch is designed for dry foodstuffs, which do not need to be sterilized after packaging. In situations in which the contents of the pouch must be retorted (sterilizing the contents), however, the packaging must be able to maintain the seal of the enclosed space through the retort process. This creates a difficulty if a hand-peelable seal is desired, since the seal should be strong enough to withstand retorting while still being easy to peel apart by the consumer.

BRIEF DESCRIPTION

Embodiments described herein provide for a flexible package comprising: a first wall; a second wall opposing with the first wall, wherein the first wall and the second wall are flexible; one or more permanent seals sealing the first wall to the second wall; an easy-peel seal sealing the first wall to the second wall, and having an elongated shape with a first and second end; and a plurality of flaps extending outward from the easy-peel seal, wherein the one or more permanent seals and the easy-peel seal define edges of an enclosed space between the first wall and the second wall, wherein the easy-peel seal extends between portions of the one or more permanent seals forming a first intersection of the first end of the easy-peel seal and the one or more permanent seals and a second intersection of the second end of the easy-peel seal and the one or more permanent seals; wherein when opening the package by pulling apart the plurality of flaps, the effective peeling force increases at least 5 N as the package is opened to the first and second intersections of the easy-peel seal and the one or more permanent seals; wherein the elongated shape of the easy-peel seal defines a convex portion which projects away from the enclosed space.

Other embodiments described herein provide for a flexible package comprising: a first wall; a second wall opposing with the first wall, wherein the first wall and second wall are flexible, wherein the package is configured to be opened proximate a first edge thereof; one or more seals sealing the first wall to the second wall and defining one or more edges of an enclosed space between the first wall and the second wall, the one or more seals including: a first seal portion extending from the first edge of the package toward a distal edge of the package, wherein an internal edge of the first portion defines a first edge of the enclosed space and an external edge of the first portion defines a second edge of the package; a second seal portion extending from the first edge of the package toward the distal edge of the package, wherein an internal edge of the second portion defines a second edge of the enclosed space laterally opposite the first edge of the enclosed space and an external edge of the second portion defines a third edge of the package laterally opposite the second edge of the package, wherein the first and second seal portions increase in width from the first edge toward the distal edge, wherein the second edge of the package and the third edge of the package are substantially parallel with one another, and wherein the first edge and the second edge of the enclosed space are angled with respect to one another forming an enclosed space which increases in width from the distal edge toward the first edge thereof Still other embodiments described herein provide for a flexible package comprising: a first wall; a second wall opposing with the first wall, wherein the first wall and second wall are flexible, wherein the first wall and the second wall define: one or more seals sealing the first wall to the second wall and defining one or more edges of an enclosed space between the first wall and the second wall; and a plurality of package edges including: a first longitudinal edge; a second longitudinal edge substantially parallel with the first longitudinal edge; a third edge substantially transverse to the first edge and the second edge; a fourth edge extending between the first edge and the second edge, wherein the packaged is configured to be opened proximate the fourth edge, wherein the first edge and the second edge include a concave portion disposed between adjacent linear portions.

Yet other embodiments described herein provide for a method of manufacturing a wall of a flexible package, the method comprising: cutting at least a first row and a second row of package walls out of a sheet of flexible material such that each wall of the first row and second row has a common geometry and defines; a first longitudinal edge; a second longitudinal edge substantially parallel with the first longitudinal edge; a third edge substantially transverse to the first edge and the second edge; a fourth edge extending between the first edge and the second edge, wherein the fourth edge has a convex shape, wherein the first longitudinal edge of each wall of the first row and second row abuts the second longitudinal edge of an adjacent wall, wherein the fourth edge of each wall of the first row is oriented in a first direction, wherein the fourth edge of each wall of the second row is oriented in a second direction, wherein a first row of package walls is oriented 180 degrees in relation to a second row of package walls such that the fourth edge of the walls in the first row are oriented towards the fourth edge of the walls in the second row, wherein the first row of package walls is offset from the second row of package walls such that the convex shapes of the first row extend into concave areas defined between adjacent convex shapes of the second row and the convex shapes of the second row extend into concave areas defined between adjacent convex shapes of the first row.

DRAWINGS

Understanding that the drawings depict only exemplary embodiments and are not therefore to be considered limiting in scope, the exemplary embodiments will be described with additional specificity and detail through the use of the accompanying drawings, in which.

Figure 2:
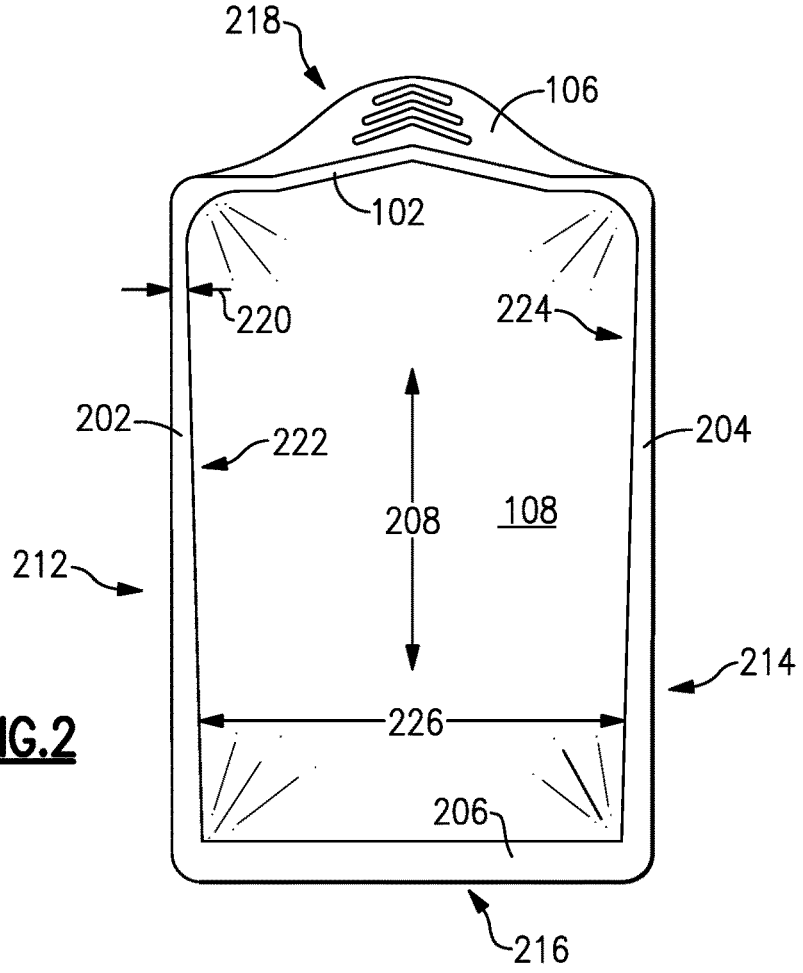
FIG. 2 is a front view of the pouch of FIG. 1A.
Figure 5A:
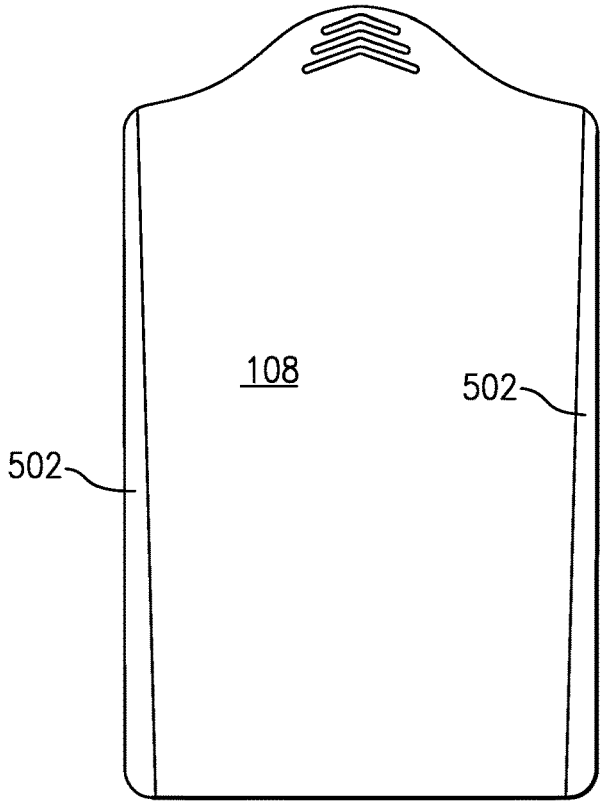
Figure 5B:
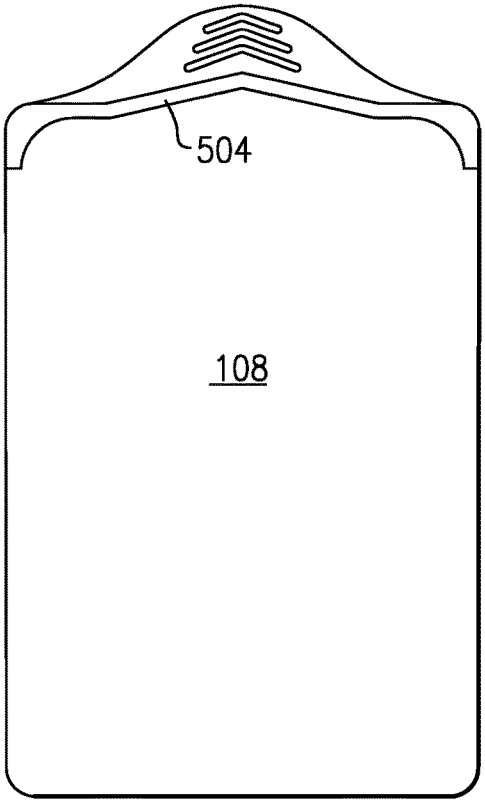
Figure 5C:
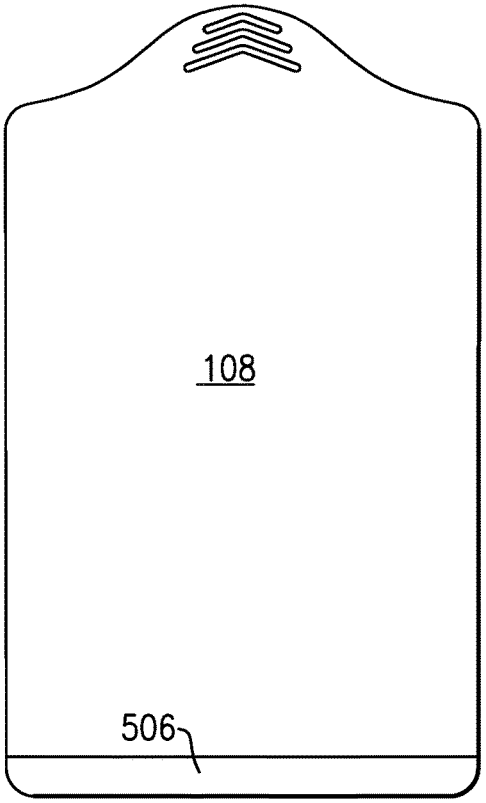

FIGS. 5A, 5B, and 5C are front views of the pouch of FIG. 2 showing example coverage areas for application of thermal/ultrasonic energy to create the one or more permanent seals and the easy-peel seal.

Figure 1A:
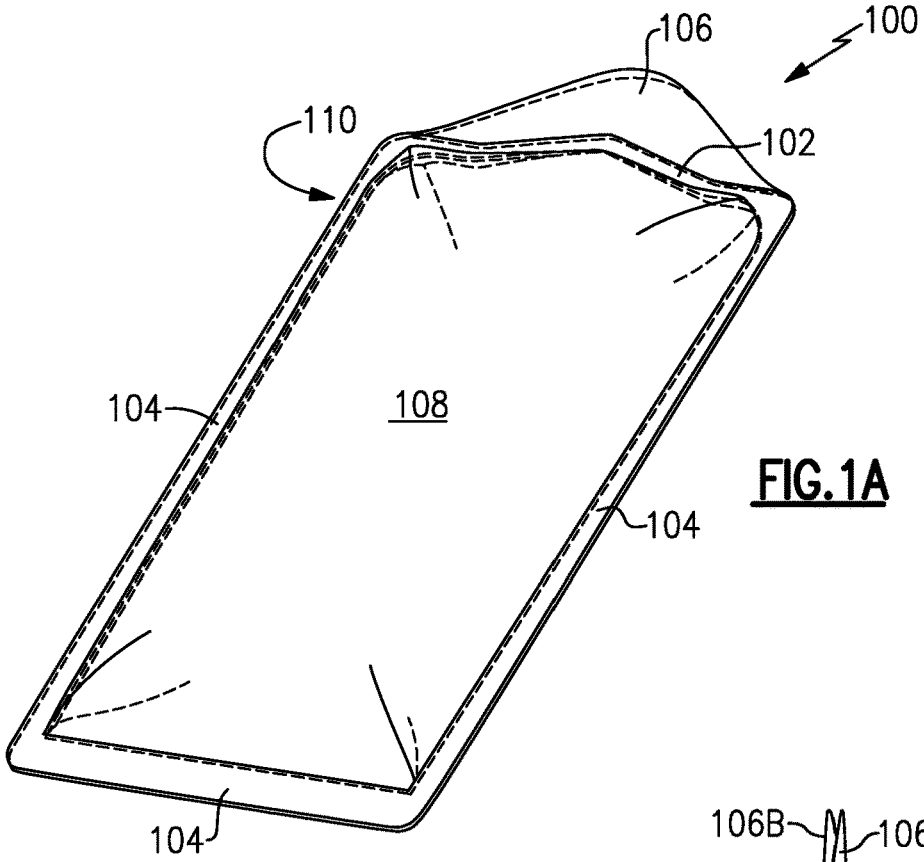
FIG. 1A is a front perspective view of an example filled pouch.
Figure 6:
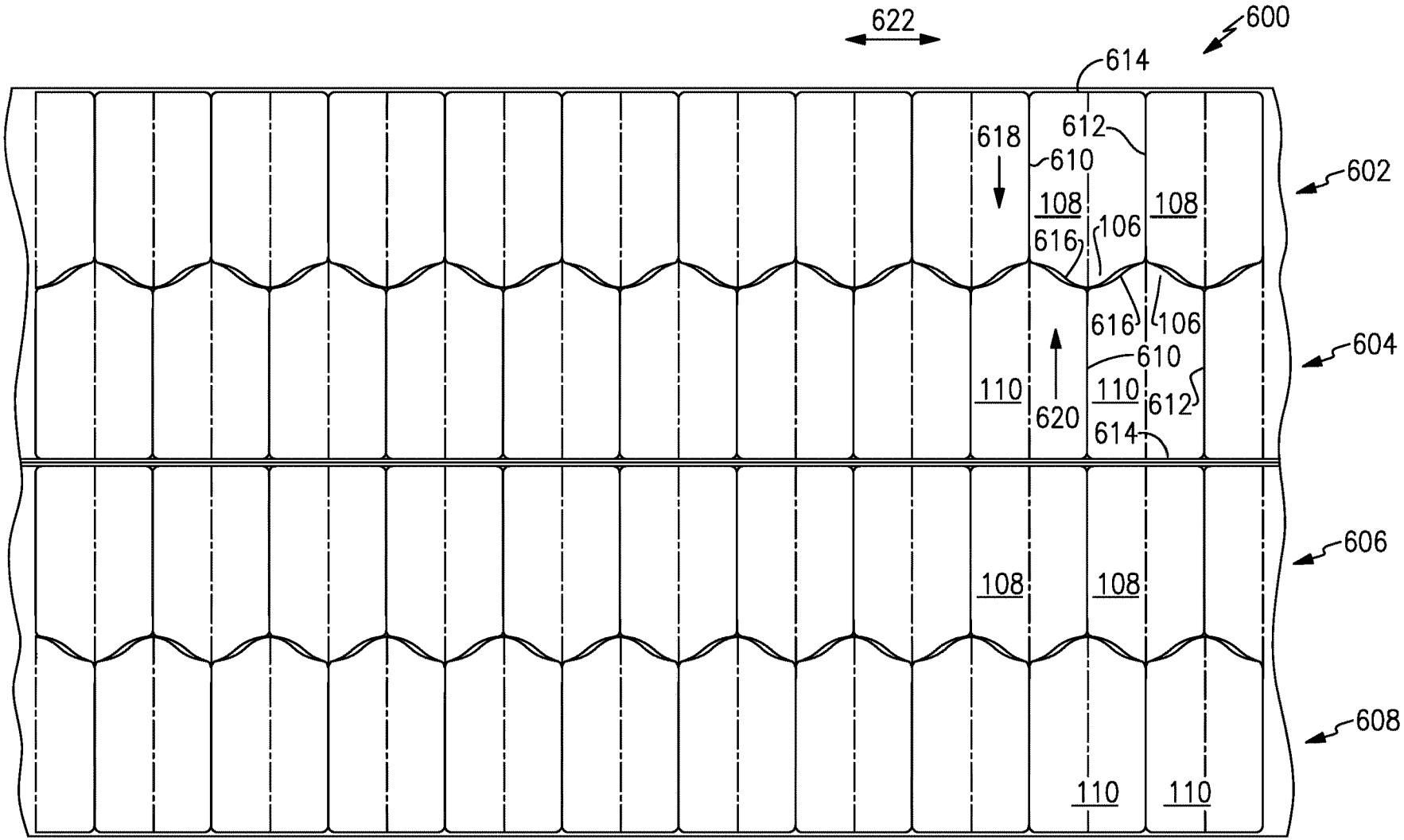

FIG. 6 is a top view showing an example pattern in which walls for the pouch of FIG. 1A can be cutout of a sheet of material.

Figure 7:
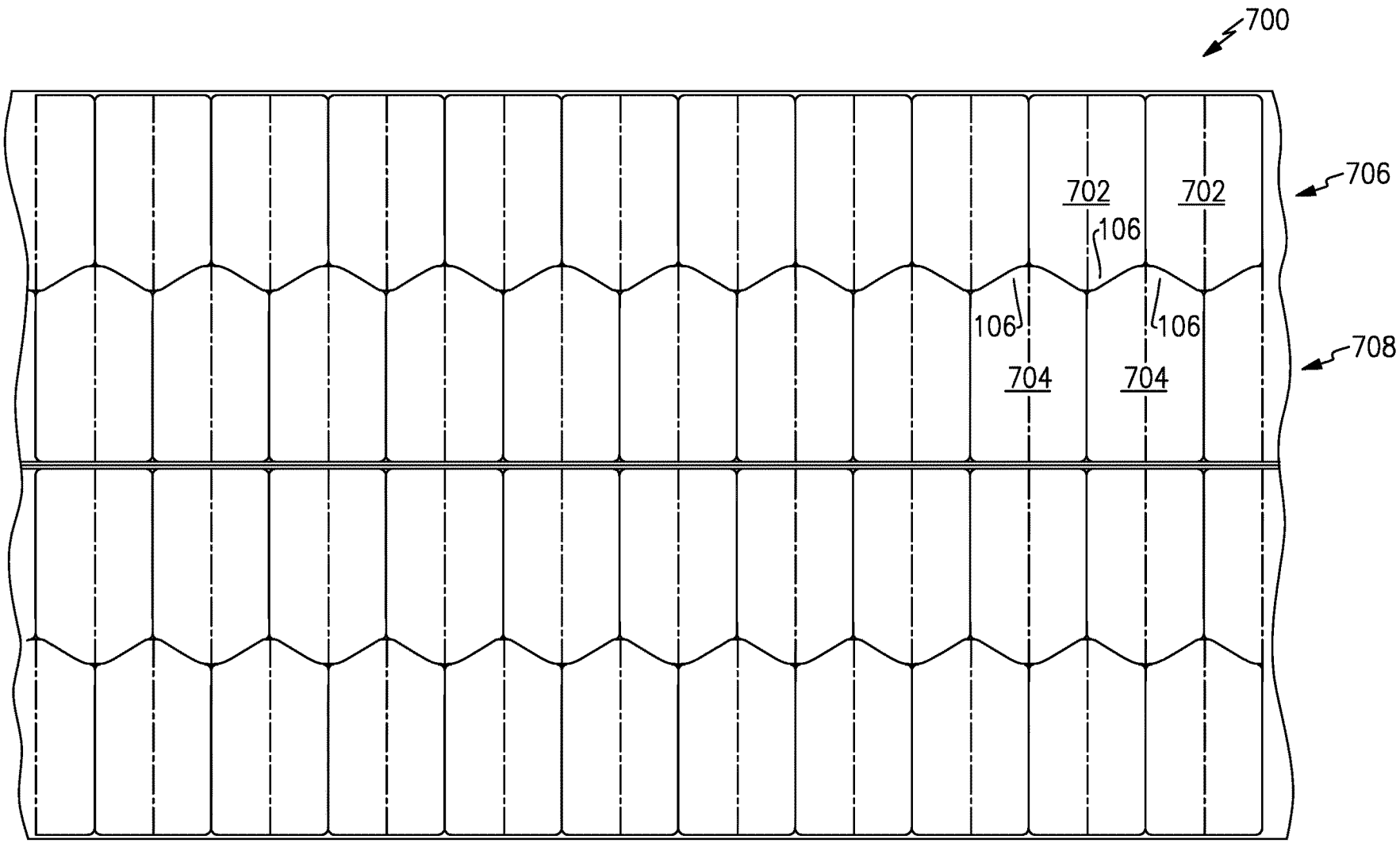

FIG. 7 is a top view showing another example pattern in which walls for a pouch can be cutout of a sheet of material.

Figure 8A:
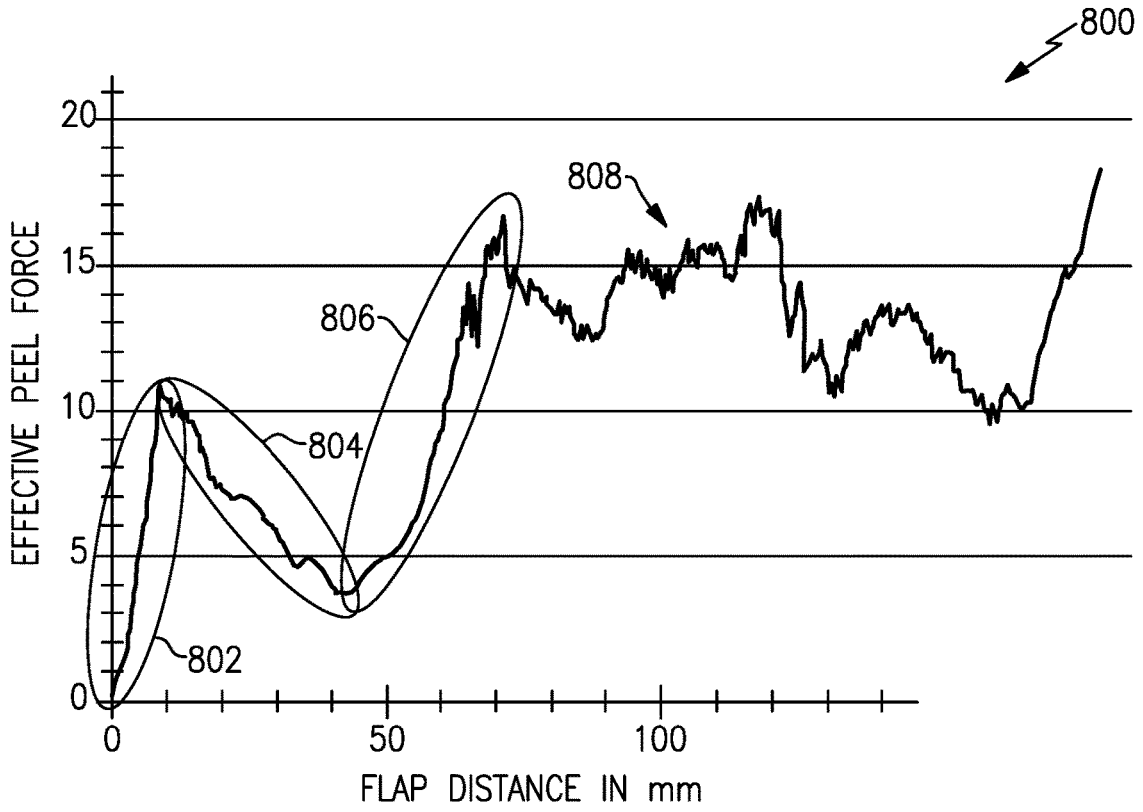

FIG. 8A is a graph showing an example effective peel force during opening of the pouch of FIG. 1A.

Figure 8B:
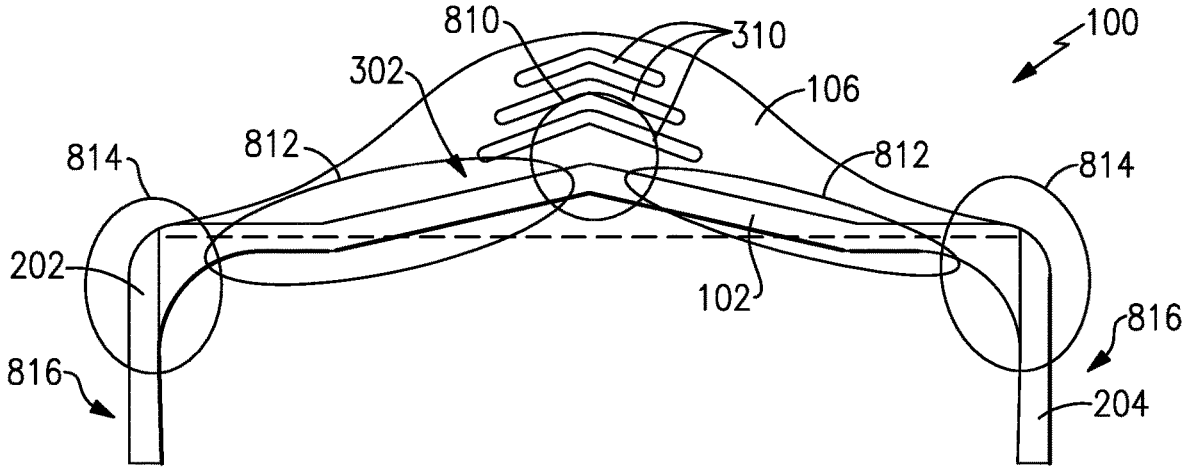

FIG. 8B is a cut-away front view of the pouch of FIG. 1A showing the areas of the seals that correspond to the graph of FIG. 8A.

DETAILED DESCRIPTION

The terms "first", "second", and the like, as used herein do not denote any order, quantity, or importance, but rather are used to distinguish one element from another. Also, the terms "a" and "an" do not denote a limitation of quantity, but rather denote the presence of at least one of the referenced item, and the terms "front", "back", "bottom", and/or "top", unless otherwise noted, are merely used for convenience of description, and are not limited to any one position or spatial orientation.

Reference throughout the specification to "one example" or "an example" means that a particular feature, structure, or characteristic described in connection with an example is included in at least one embodiment. Thus, the appearance of the phrases "in one example" or "in an example" in various places throughout the specification is not necessarily referring to the same embodiment. Further, the particular features, structures or characteristics may be combined in any suitable manner in one or more embodiments.

Figure 1B:
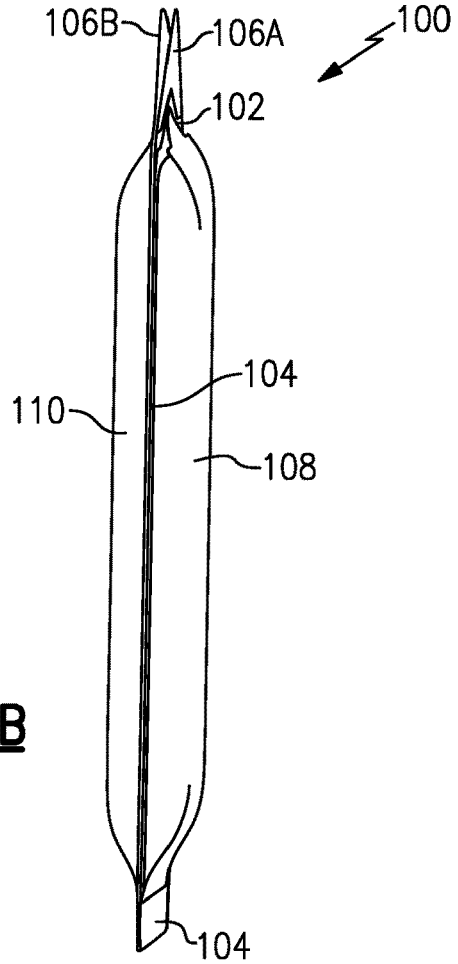
FIG. 1B is an edge perspective view of the filled pouch of FIG. 1A.

FIG. 1A is a front perspective view and FIG. 1B is an edge perspective view of an example flexible package 100 (also referred to herein as "pouch 100") having contents therein. The pouch 100 has an easy-peel seal 102 that is both easy-to-open and maintains a sufficiently strong seal. The pouch 100 is composed of two walls 108, 110 that are sealed together at a plurality of locations to form an enclosed space. The two walls 108, 110 are disposed opposite one another and are sealed together to define the edges of the enclosed space.

The walls 108, 110 of the pouch 100 are flexible. As used herein, flexible means that the walls 108, 110 are configured to bend substantially and remain in a bent state in response to contents being inserted into the pouch 100. In an example, the walls must also be suitable for retorting. To be suitable for retorting the walls must be able to maintain an airtight seal for the enclosed space through the retort process. Example plastics that can be included in the walls 108, 110 include polypropylene, polyester, polyethylene, polyamide and/or a bio-based/bio-degradable plastic. In many examples, the walls are a laminate (e.g., 2 ply, 3 ply, 4 ply) including at least one layer of plastic. In a particular example, the walls 108, 110 are a laminate including a layer of polyethylene terephthalate (PET) for the outside of the pouch, a layer of polypropylene for the inside of the pouch, and a layer of aluminum therebetween. Other examples are also possible. Examples of wall compositions that are not considered flexible and are not suitable for pouch 100 include cardboard, boxboard, and the like.

In the example shown in FIGS. 1A and 1B, the two walls 108, 110 have an identical geometry and the two walls 108, 110 are superposed to form the pouch 100. With the two walls 108, 110 superposed, all of the edges of the wall 108 are aligned with the edges of wall 110 and vice versa. In alternative examples, the two walls 108, 110 can have different respective geometries and/or can be disposed opposite one another such that some of the edges of wall 108 do not align with an edge of wall 110. The two walls 108, 110 can be portions of a single piece of material or can be distinct pieces of material.

The areas of the two walls 108, 110 that are sealed together are referred to herein as seals. The seals define the edges of the enclosed space. The seals include one or more permanent seals 104 and an easy-peel seal 102. The one or more permanent seals are formed in a manner that is not intended to be peeled apart by a consumer. Accordingly, the one or more permanent seals 104 are formed with a higher effective peel force. The easy-peel seal 102 is formed in a manner that is intended to be hand-peeled apart by a consumer in order to access the contents of the pouch 100. Accordingly, the easy-peel seal 102 is formed with a lower effective peel force than the permanent seal(s) 104.

The easy-peel seal 102 is disposed to form a first edge of the enclosed space, while other edges of the enclosed space are formed by the permanent seal(s) 104. In the example shown herein, the enclosed space has a generally rectangular geometry although other shapes can also be used.

The pouch 100 also includes a plurality of flaps 106 that project outward from the easy-peel seal 102. At least a first flap 106*a* is formed of a portion of the piece of material that forms the first wall 108, and at least a second flap 106*b* is formed of a portion of the piece of material that forms the second wall 110. This enables the first flap 106*a* to be grabbed by one hand of a consumer and the second flap 106*b* to be grabbed by the other hand of the consumer. The consumer can then pull the flaps away from one another to peel apart the easy-peel seal 102, and thus open the pouch 100. In the example shown in FIG. 1, two flaps 106*a*, 106*b* are shown, each having a single outward projection with a rounded profile. In other examples, however, one or more of the flaps 106 can have multiple outward projections and/or the outward projection(s) can have a profile other than rounded (e.g., triangular, square, etc.). Additionally, in the example shown in FIG. 1, the two flaps 106*a*, 106*b* have the same profile and are superposed over one another, however, in other examples, one or more of the flaps 106 can have a different profile than an opposing flap and/or can be offset from an opposing flap.

Advantageously, providing an easy-peel seal 102 on a first edge of the enclosed space that has a lower effective peel force than permanent seal(s) 104 forming other edges of the enclosed space enables a consumer to open one edge of the enclosed space by pulling apart the easy-peel seal 102, without opening the other edges formed by the permanent seal(s) 104. In particular, as the easy-peel seal 102 is pulled apart, when the pulled-apart seal reaches the junctions between the easy-peel seal 102 and the one or more permanent seals 104, there is a substantial increase in effective force required to continue pulling apart the seal(s). This increase in force is a tactile signal to the consumer to stop pulling and provides resistance to pulling apart more than the easy-peel seal 102 (e.g., resistance to pulling apart the permanent seal(s) 104).

Since opening the easy-peel seal 102 results in only one edge of the enclosed space being opened, and the opening is via breaking of the seal, the enclosed space 102 can be opened with less risk of spilling the contents of the enclosed space. In particular, in conventional pouches in which a top portion is torn off to open the enclosed space, the tear necessarily tears portions of the wall defining the enclosed space. Thus, a portion of the contents may unintentionally spill out during opening. Opening with the easy-peel seal 102 described herein, however, does not tear the walls of the enclosed space. Thus, the risk of unintentionally spilling out the contents of the enclosed space is reduced.

In an example, a resin is used in between the walls in the area of the easy-peel seal 102 to aid in forming a suitable seal. In an example, the resin is disposed on the entire internal surface of at least one of the walls 108, 110. In an alternative example, such resin is applied only to portions of at least one of the walls 108, 110 in and around the seals 102, 104 and is not applied to other portions of the walls 108, 110. In either case, the resin can be applied to only one of the walls 108, 110 or to both walls 108, 110. Notably, the same resin can be used to create both the easy-peel seal 102 and the one or more permanent seals 104. The difference in strength between the easy-peel seal 102 and the permanent seals 104, therefore, is not created by use of a different resin or wall material. Instead, the difference in peel force is created by using a different combination of sealing time, force/energy, and temperature for the different seals 102, 104 as discussed above. An example resin for use in creating the seals 102, 104 is the Sealution™ resin manufactured by The Dow Chemical Company of Midland Michigan Advantageously, the easy-peel seals 102 and permanent seal(s) 104 made with the Sealution™ resin are suitable for retorting. That is, the seals 102, 104 can maintain an airtight seal around the enclosed space through the retort process. Other resins may also be used.

In the example shown in FIGS. 1A and 1B, the pouch 100 consists of the two planar walls 108, 110 and any resins thereon. No other walls or sections of material are included. In other examples, however, a gusset can be included between the planar walls 108, 110 in the area laterally opposite of the easy-peel seal 102 to form what is commonly referred to as a stand-up pouch. The gusset can be a portion of a common piece of material with one or both of the walls 108, 110 or can be distinct piece of material. Other flexible package constructions are also possible.

FIG. 2 is a front view of the pouch 100 shown in FIG. 1A. The one or more permanent seals of the pouch 100 include a first portion 202 and a second portion 204, each having an elongated shape that extend substantially parallel to one another in a first direction 208. The easy-peel seal 102 has an elongated shape that extends in a direction substantially transverse to the first direction 208. The easy-peel seal 102 extends between the first portion 202 and the second portion 204 of the one or more permanent seals, forming a continuous seal including the first portion 202, the easy-peel seal 102 and the second portion 202.

In the example shown in FIGS. 1A-2, the two walls 108, 110 are formed from different pieces of material. Accordingly, the one or more permanent seals 104 also include a third portion 206 having an elongated shape that extends between the first portion 202 and the second portion 204, laterally opposite the easy-peel seal 102. Accordingly, the easy-peel seal 102, along with the first portion 202, the second portion 204, and the third portion 206 of the one or more permanent seals 104 form a continuous seal defining the perimeter of the enclosed space of the pouch 100.

The easy-peel seal 102 and the one or more permanent seals 104 form a substantially rectangular perimeter around the enclosed space. In the examples shown in FIGS. 1A, 1B, and 2, the long edges of rectangular perimeter are formed by the first portion 202 and the second portion 204 of the one or more permanent seals 104, and the short edges of the rectangular shape are formed by the third portion 206 and the easy-peel seal 102. In other examples, however, the seals 102, 104 can form a substantially square perimeter around the enclosed space or the long edges and short edges can be switched from that shown herein such that the long edges are formed by the easy-peel seal 102 and the third portion 206 and the short edges are formed by the first portion 202 and second portion 204.

In the example shown in FIGS. 1A, 1B, and 2, the pouch 100 has a generally rectangular shape. The first portion 202 and second portion 204 of the permanent seal(s) 104 extend along and define two edges 212, 214 of the rectangular pouch 100. In this example, the first portion 202 extends along a first edge 212 of the pouch 100 and the second portion 204 extends along a second edge 214 of the pouch 100, wherein the first edge 212 of the pouch 100 is laterally opposite the second edge 214 of the pouch 100. In this example, the third portion 206 extends along and defines a third edge 216 of the pouch 100. In an alternative example in which the two walls 108, 110 are formed from a common piece of material, the third edge 216 of the pouch 100 can be formed by a fold in the common piece of material. In such an alternative example, the third portion 206 of the one or more permanent seals may not be used. In yet other examples, one or more of the first portion 202, second portion 204, or third portion 206 can be disposed inward of the respective edge of the pouch 100.

The easy-peel seal 102 can be disposed proximate a fourth edge 218 of the pouch 100. In the example shown in FIG. 2, the fourth edge 218 of the pouch 100 is defined by the flaps 106 that project outward from the easy-peel seal 102. Thus, in the implementation shown in FIGS. 1A, 1B, and 2, the first edge 212, second edge 214, and third edge 216 of the pouch 100 are three sides of a hypothetical rectangle and the fourth side of the rectangle is replaced with the curved edge 216 of the flap 106.

In the example shown in FIG. 2, the first portion 202, second portion 204, and third portion 206 of the permanent seal(s) 104 have straight internal and external edges with radiused intersections there between. In other examples, however, one or more of the edges of the permanent seal(s) 104 can have curved portions and/or the intersections are not radiused. The easy-peel seal 102 has a complex shape discussed in detail below. The intersections between the easy-peel seal 102 and the first portion 202 and second portion 204 can also be radiused.

The easy-peel seal 102 and the one or more permanent seals 104 can have any suitable width. In an example, the easy-peel seal 102 and the one or more permanent seals 104 can all have the same width 220, for example, of 3 mm. Other widths can also be used.

In the example shown in FIG. 2, however, the width 220 of the first portion 202 and the second portion 204 of the one or more permanent seals 104 is not constant. Instead, the width 220 of the first portion 202 and the second portion 204 increases from the end proximate the easy-peel seal 102 at least a portion of the way to the end that is distal from the easy-peel seal 102. The increase in width 220 can be gradual and even along the length of the first and second portions 202, 204 as shown in FIG. 2 or the increase can be stepped or formed in some other manner. In the implementation of this example, the width 220 increases all the way from easy-peel seal 102 to the third edge 216.

Advantageously, the increase in width 220 enables the respective outside edges 212, 214 of the pouch 100 formed by the first and second portions 202, 204 to be parallel to one another, while the internal edges 222, 224 of the first and second portions 202, 204 defining the enclosed space can be angled with respect to one another. This angled relationship of the internal edges 222, 224 of the first and second portions 202, 204 can advantageously form an internal space that increases in width 226 at least near the easy-peel seal 102, and in the example shown in FIG. 2 the enclosed space can increase in width 226 along the entire length from the third edge 216 toward the easy-peel seal 102.

This increase in width 226 towards the opening end of the pouch 100 can aid in the release of the contents from the pouch 100 after opening. This can be particularly beneficial if the contents of the pouch 100 are wet and viscous, such as a gelatinous substance. In such a situation, the contents of the pouch 100 tend to be held in the pouch 100 due to the suction caused by the viscous materials blocking airflow into the pouch 100. The increase in width 226 of the enclosed space toward the opening of the pouch 100 provided by the decreasing width 220 of the first and second seam portions 202, 204 can reduce this suction. Moreover, this increase in width 226 of the enclosed space is provided without having to form a package having a correspondingly tapered edges 212, 214. This enables adjacent pouches 100 in the assembly process to be formed with a common exterior edge 212, 214 because the edges 212, 214 of the pouches 100 can be perpendicular to the sheets of material.

The first and second portions 202, 204 can increase in width 220 by at least 25 percent (i.e., 1.25 times) or at least 50 percent (i.e., 1.5 times) from the end proximate the easy-peel seal 102 to the distal end. In a particular example, the first and second portions 202, 204 increase in width 220 by at least 2 mm. In a more specific example, the first and second portions 202, 204 have a width 220 that is less than 3.5 mm proximate the easy-peel seal 102 and is at least 5.5 mm at the end distal of the easy-peel seal 102. In the example shown in FIG. 1, the first and second portions 202, 204 are about 3 mm at the ends proximate the easy-peel seal 102 and are about 6 mm at the ends distal from the easy-peel seal 102.

In other examples, the first portion 204 and second portion 202 can have other geometries such as having a constant width 220 (e.g., 3 mm) along their respective lengths. In such examples, the inside edge 222, 224 of the first portion 202 and second portion 204 can be straight and can define a constant width 226 for the enclosed space from the end distal to the easy-peel seal 102 to the easy-peel seal 102. While such a constant width 226 may not provide as much suction relief as an increasing width 226 of the enclosed space as discussed above, it can provide some suction relief as compared to configuration in which the width 226 of the enclosed space decreases near or towards the opening portion.

In other examples, the easy-peel seal 102 and the one or more permanent seals 104 can form other shapes and/or the pouch 100 can have a different shape. In the example shown a single enclosed space is formed on the pouch 100, however, in other examples multiple enclosed spaces can be disposed on a single pouch, each enclosed space having a respective easy-peel seal 102 and permanent seal(s) 104.

Figure 3:
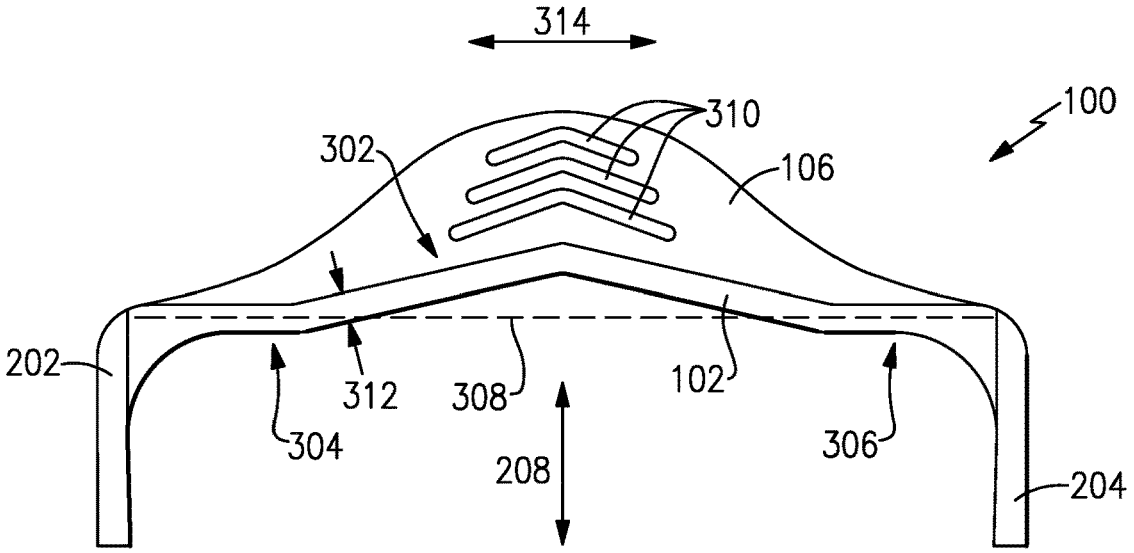
FIG. 3 is an enlarged cut-away front view of the pouch of FIG. 2 showing the easy-peel seal and flap.

FIG. 3 is an enlarged cut-away front view of a portion of the pouch 100 from FIG. 1A. FIG. 3 shows the easy-peel seal 102 and flap 106 in greater detail. As shown, the elongated shape of the easy-peel seal 102 curves outward to form a two-dimensionally convex portion 302 that projects away from a center of the enclosed space. The easy-peel seal 102 also includes two linear portions 304, 306. Each linear portion 304, 306 extends from one end of the convex portion 302. The first linear portion 304 extends from the convex portion 302 and intersects with the first portion 202 of the permanent seal. Likewise, the second linear portion 306 extends from the convex portion 302 and intersects with the second portion 204 of the permanent seal(s). The linear portions 304, 306 can intersect the respective portions 202, 204 of the permanent seal(s) at equal longitudinal (along first direction 208) locations along the respective portions 202, 204. A hypothetical line 308, substantially perpendicular to the first portion 202 and the second portion 204, can be defined between the intersection of the first portion 202 and the first linear portion 304 and the intersection of the second portion 204 and the second linear portion 306. In this example, the linear portions 302, 304 extend along this hypothetical line 308, and thus intersect the first portion 202 and second portion 204 of the permanent seal(s) at approximately a right angle. In an alternative example, the entire easy-peel seal 102 consists of only the convex portion 302, such that the easy-peel seal 102 begins projecting outward immediately from the intersections with the permanent seal(s), and no linear portions 202, 204 are included.

The convex portion 302 while being convex from a perspective outside of the enclosed space, is two-dimensionally concave from a perspective inside the enclosed space. In this example, the convex portion 302 has a chevron shape, however, in other examples, the convex portion 302 can have other shapes such as a smooth arc. In this example, the two linear portions 304, 306 are substantially equal in length such that the convex portion 302 is centered along the length of the easy-peel seal 102.

The convex portion 302 can project outward at least 2 mm, such that the apex of the external edge of the convex portion 302 is at least 2 mm outward of the hypothetical line 308 extending between the locations in which the easy-peel seal 102 and permanent seal(s) 104 intersect. In the example shown in FIG. 2, the apex of the convex portion 302 is about 3 mm outward from the hypothetical line 308.

The convex shape of the convex portion 302 focuses the peeling force applied to the flaps 106 onto the apex of the convex portion 302. This enables a large portion of the peeling force applied by the consumer to be focused on a small portion of the easy-peel seal 102. In turn, this enables a given magnitude of force to peel apart a seal having a comparatively higher peeling force than a straight (non-convex) seal. This affect can be utilized to construct a pouch 100 having an easy-peel seal 102 with a comparatively higher seal strength than a straight-edged pouch, which may reduce the likelihood of the easy-peel seal 102 opening unintentionally, such as during a retort process. Such a retort process can include heating the pouch 100 having contents enclosed therein at 130 degrees Celsius for 45 minutes.

In this example, the easy-peel seal 102 intersects the respective portions 202, 204 of the permanent seal(s) at the respective ends thereof, such that neither the first portion 202 nor the second portion 204 extends past the intersection with the easy-peel seal 102. Thus, the outer edge of the intersections between the easy-peel seal 102 and the respective portions 202, 204 of the permanent seal(s) can define the edge-corner of the pouch 100. Additionally, having the intersection of the easy-peel seal 102 and the permanent seal(s) at the end of the permanent seal(s) enables the convex portion 302 of the easy-peel seal 102 to project further outward toward the fourth edge of the pouch 100 than the permanent seal(s). Thus, when opening the pouch 100 using the flaps 106, the convex portion 302 is the first part of the seals 102, to which force is applied, and the force can accordingly be focused on the convex portion 302, and not on the permanent seal(s).

In the example shown in FIG. 3, the width 312 of the easy-peel seal 102 is constant through the first linear portion 304, the convex portion 302, and the second linear portion 306, not including the radiused intersection with the permanent seal(s) 104. In other examples, however, the width 312 of the easy-peel seal 102 can vary along its length. For instance, the width 312 of the easy-peel seal 102 could be greater near the intersections with the permanent seal(s) 104 and less at the apex of the convex portion 302. In such an implementation, the width could vary gradually from the intersections with the permanent seal(s) 104 to the apex and/or could vary in a stepwise manner. Such a varied width may be beneficial to allow easy starting of the opening of the easy-peel seal 102 while providing more resistance to opening as the easy-peel seal 102 is further opened, closer to the permanent seal(s) 104. The increased resistance to opening closer to the permanent seal(s) 104 can provide a tactile signal to the consumer that the end of the opening portion is being reached. The consumer can respond to this tactile signal by reducing the force applied, which can reduce the chances of the permanent seal(s) 104 also being broken and/or of the wall 108, 110 being torn after the easy-peel seal 102 is fully opened.

The flaps 106 shown in FIGS. 1A, 1B, 2, and 3 have a curved outer edge forming a two-dimensionally convex shape that is aligned horizontally 314 with the convex portion 302 of the easy-peel seal 102 (i.e., the apex of the flap 106 is aligned horizontally 314 with apex of the convex portion 302). As discussed above with respect to FIGS. 1A and 1B, other configurations for the flaps 106 can be used.

The flaps 106 also include one or more features 310 which are raised or sunken in the flap 106. The one or more features 310 can aid in providing grip for a consumer when pulling the flaps 102 to open in the easy-peel seal. In the example shown in FIG. 3, the one or more features 310 includes a plurality of elongated features extending in a direction generally parallel to the easy-peel seal 102. In particular, the plurality of elongated features can be chevrons or arcs that project in the same direction as the convex portion 302 of the easy-peel seal 102 and are aligned horizontally 314 with the convex shaped flap 106 and/or the convex portion 302 of the easy-peel seal 102. In other examples, other geometries of features can be used such as dots. The one or more features 310 can be raised or sunken at least 0.5 mm or at least 1 mm with respect to the main surface of the flap 106. The one or more features 310 can be formed in any suitable manner such as through embossing.

As used herein, the "effective peel force" of a seal 102, 104 is intended to correspond closely to the magnitude of force experienced by a consumer when opening the pouch 100. That is, it is intended that the easy-peel seal 102 require a lower "real-life" (hand-peelable) force to open than the permanent seal(s) 104. Accordingly, as used herein, the effective peel force of the easy-peel seal 102 is the magnitude of force measured with a Zwick™ sealed-seam tester for flexible packaging materials, set-up such that the tester opens the easy-peel seal 102 in the manner intended for opening by the consumer. Thus, to measure the effective peel force of the easy-peel seal 102, the Zwick™ sealed-seam tester is secured to the flaps 106 of the pouch 100, and pulls apart the flaps 106 to open the easy-peel seal 102 in a steady manner. The magnitude of force measured with the Zwicki™ sealed-seam tester while the easy-peel seal is being pulled apart, until the easy-peel seal 102 is fully opened, is the effective peel force for the easy-peel seal 102.

The effective peel force of the permanent seal(s) 104 is the magnitude of force measured with a Zwick™ sealed-seam tester as the flaps 106 are pulled further apart, after the easy-peel seal 102 is fully opened, while pulling apart the permanent seal(s) 104. Pulling the flaps 106 further apart after the easy-peel seal 102 is fully opened can cause the permanent seal(s) 104 to be opened. The magnitude of force measured by the tester during the opening of the permanent seal(s) 104 is the effective seal force thereof.

FIG. 8A is an example graph 800 showing the effective peel force of an example pouch 100 after sterilization, as measured by pulling apart the flaps 106 as described herein. FIG. 8B illustrates the portions of the seals 102, 104 that correspond to the effective peel force in the graph 800. In graph 800, the vertical axis represents the effective peel force in Newtons (N) and the horizontal axis represents the distance the flaps 106 are pulled apart.

As shown, there is a starting period 802 representing the force required to initiate pulling apart of the easy-peel seal 102. With reference to FIG. 8B, the starting period 802 corresponds to the pulling apart of the apex 810 of the convex portion 302 of the easy-peel seal 102. In this example, the starting period 802 peaks at about 11 N. Other examples can have other starting period 802 peaks of other values. In respective examples, the peak of the starting period 802 of the easy-peel seal 102 is in the range of 5 N to 20 N, 7.5 N to 15 N, or 7.5 N to 12.5 N.

Once pulling part of the easy-peel seal 102 has started, the effective peel force decreases as the easy-peel seal 102 is further pulled apart during period 804 of the graph 800. This period 804 of the graph 800 corresponds to the pulling part of the easy-peel seal 102 in the regions shown at 812 of FIG. 8B. Regions 812 correspond to the easy-peel seal 102 from the apex 810 of the convex portion 302 to the intersections with the portions 202, 204 of the permanent seal(s) 104. In this example, the effective peel force during period 804 corresponds to about 30 mm of distance pulling the flaps 106 apart. This distance, however, will depend on the length of the easy-peel seal 102. In respective examples, this period 804 of lower force than the peak of the starting period 802 corresponds to at least 20 mm, at least 30 mm, or at least 40 mm of distance pulling apart the flaps 106.

In an example, the decrease in effective peel force as the easy-peel seal 102 is pulled apart during period 804 can be a generally smooth decrease, which provides a pleasant opening experience for the consumer. In this example, the effective peel force during period 804 decreases from the peak of the starting period 802 of around 11 N to around 4 N. In other examples, the effective peel force during period 804 can decrease to other values and/or at other rates. For example, the effective peel force during period 804 can decrease to a value of at least 2.5 N, or at least 5 N, less than the peak of the starting period 802. In an example, the effective peel force during period 804 is less than the peak of the starting period 802 throughout the period 804.

As shown, the peak of the starting period 802 is a substantially higher force than the effective peel force to continue opening the easy-peel seal 102 during period 804. The convex shape of the convex portion 302 of the easy-peel seal 102 can reduce the peak of the starting period 802 as compared to a starting peak of a straight (non-convex) easy-peel seal. Keeping the peak of the starting period 802 low enables easier opening by a consumer.

As the easy-peel seal 102 is fully pulled apart, the pulled-apart seal reaches the intersection 814 with the permanent seal(s) 104, causing a substantial increase in the effective peel force. This increase in effective peel force is shown at period 806 of graph 800 and corresponds generally to peeling apart the intersections 814 of the easy-peel seal 102 and the permanent seal(s) 102 shown in FIG. 8B. In an example, this sharp increase is an increase of at least 5 N, at least 7.5 N, or at least 10 N. In an example, this sharp increase is experienced over a distance of less than 40 mm, less than 30 mm, or less than 20 mm of pulling the flaps 106 apart. In this example, the peak of this increase is around 17 N. In respective other examples, the peak of this increase is at least 10 N, at least 12.5 N, at least 15 N, or at least 20 N.

Since the permanent seal(s) are not designed to be peeled apart, the effective peel force during further pulling apart of the permanent seal(s) can vary irregularly as shown by period 808 of graph 800 to the right of period 806. Period 808 corresponds to further peeling apart of the portions 816 of the permanent seal(s) 102. In this example, during further pulling apart of the portions 202, 204 of the permanent seal(s) 102, the effective peel force does not drop substantially and is at least about 10 N throughout further pulling apart.

This effective peel force of the easy-peel seal 102 and the permanent seal(s) 104 is affected by the strength of the seal and the geometry of the seal. For example, for two seals having the same strength, where one seal is wider than the other, the wider seal will have a larger effective peel force than the narrower seal, because its increased width means there is more seal to pull apart even though both seals have equivalent strengths. Likewise, for two seals having the same geometry, where one seal has a lower strength, the seal having the lower strength will have a lower effective peel force. Accordingly, the easy-peel seal 102 can be configured to have a lower effective peel force than the permanent seal(s) 104 by appropriate configuration of the seal strengths and seal geometries.

In a first example, the easy-peel seal 102 has a lower strength than the permanent seal(s) 104. As used herein the strength of a seal is the strength according to the DIN 55529 German national standard, using a 90 degree 15 mm test. Such a strength can be measured by a Zwick™ sealed-seam tester or an Instron® tester for example. Accordingly, the strength of the easy-peel seal 102 has the units of $\chi$ N/15 mm.

In respective examples, the one or more permanent seals 104 have a strength of at least 20 N/15 mm, at least 25 N/15 mm, at least 30 N/15 mm, at least 40 N/15 mm, or at least 50 N/15 mm. The easy-peel seal 102 can be formed with a strength that is less than 15 N/15 mm, less than 13 N/15 mm, less than 11 N/15 mm, less than 9 N/15 mm, or less than 7 N/15 mm. In respective examples, the easy-peel seal 102 is formed with a strength that is in the range of 5 to 7, 9, 11, 13, or 15 N/15 mm respectively.

In another example, the easy-peel seal 102 is configured to have a lower effective peel force than the permanent seal(s) 104 by having a smaller width 312 (shown in FIG. 3) than the permanent seal(s) 104. In such an example, the easy-peel seal 102 can have the same or a similar strength to the permanent seal(s) 104, and the lower effective peel force can be achieved by a smaller width of the easy-peel seal 102. In an implementation of this example, the easy-peel seal 102 has a width that is in the range of 1-2 mm and the permanent seal(s) 104 have a width that is in the range of 2.5 to 6 mm. In other examples, the easy-peel seal 102 can have both a lower strength and a smaller width 312 than the permanent seal(s) 104 to achieve the lower effective peel force.

The easy-peel seal 102 and the one or more permanent seals 104 can be formed in any suitable manner including by pressing the two walls 108, 110 together with a heated press or with ultrasonic sealing. The strength of such a seal can be set based on the length of time, magnitude of force, and temperature applied if heat pressing to create the seal, or the energy level and length of time if ultrasonic sealing to create the seal. In general, sealing for a longer time, applying more pressure/energy, and increasing the temperature all increase the strength of a resulting seal. Accordingly, the easy-peel seal 102 can be formed with a lesser strength than the one or more permanent seals 104 by sealing for one or more of a shorter length of time, a lower magnitude of pressure/energy, or a lower temperature than that used for the one or more permanent seals 104. The particular length of time, pressure/energy, and temperature used to seal the one or more permanent seals 104 and the easy-peel seal 102 will depend on the particular implementation such as, contents of the pouch, size of the pouch, intended use of the pouch, whether the pouch will be sterilized, the material of the walls of the pouch, the properties of any resins used between the walls and other factors. Manners of determining these length of time, pressure/energy, and temperature parameters are known by those skilled in the art.

Figure 4:
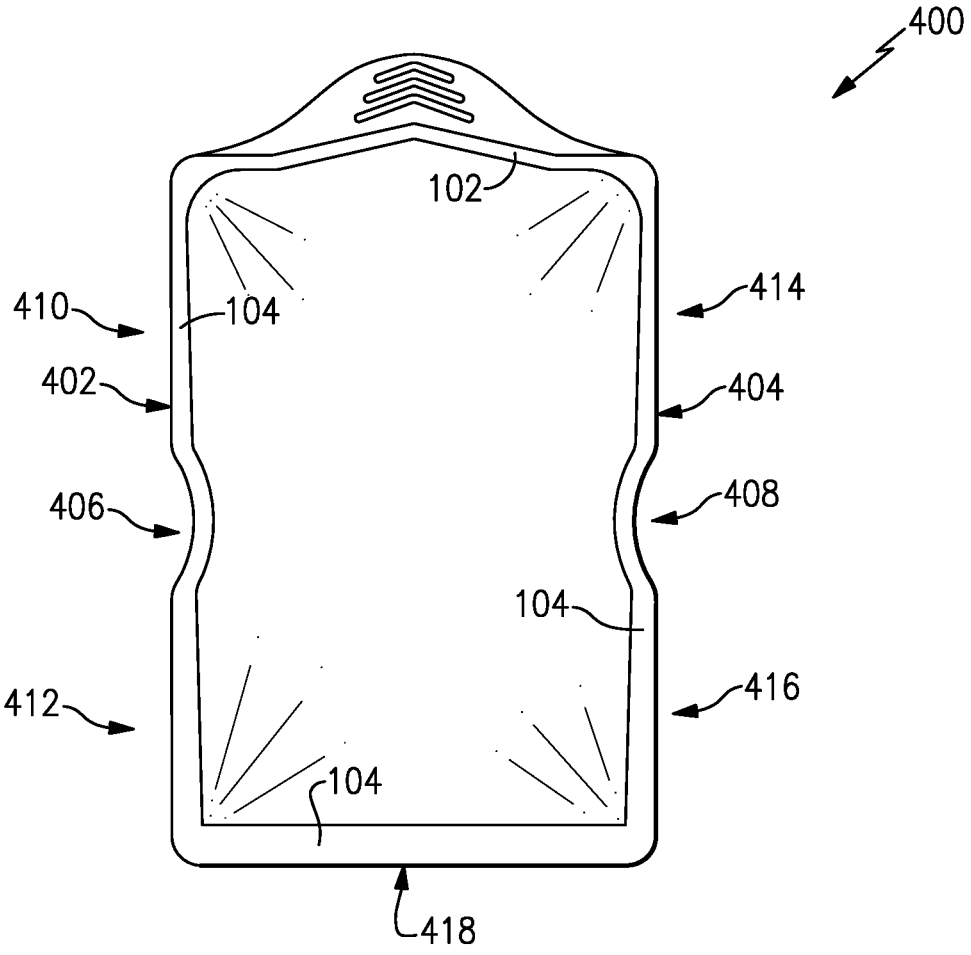
FIG. 4 is a front view of another example pouch in a filled state.

FIG. 4 is a front view of another example pouch 400 in a filled state (i.e., there are contents in the pouch 400). This pouch 400 is similar to the pouch 100 shown in FIGS. 1A, 1B, 2, and 3 except that the pouch 400 shown in FIG. 4 defines a two-dimensionally concave portion 406, 408 (from the perspective outside the pouch 400) on each of its longitudinal edges 402, 404. The concave portions 406, 408 are inward curved portions of the otherwise linear longitudinal edges 402, 404. Thus, the concave portions 406, 408 are disposed between two linear portions 410, 412, 414, 416 of their respective longitudinal edge 402, 404. The linear portions 410, 412, 414, 416 extend from the respective concave portions 406, 408 to the intersection with the easy-peel seal 102 or with the third edge 418 of the pouch 400 respectively. The concave portions 406, 408 can provide a natural location to place a finger and a thumb respectively when holding the pouch 400. Moreover, the concave portions 406, 408 can provide an aid to holding the pouch 400 when squeezing the pouch 400 to empty the contents therefrom. The concave portions 406, 408 can be disposed at substantially equal longitudinal locations on their respective edges 402, 404, such that the two concave portions 406, 408 align. In an example, the concave portions 406, 408 (i.e., the centers thereof) are disposed at a location in the range of 30 percent to 70 percent along the longitudinal length (i.e., to the ends of the linear portion 410, 412, 414, 416) of their respective longitudinal edges 402, 404. In an implementation of this example, the concave portions are disposed at a location in the range of 40-60 percent along the longitudinal length of their respective edges 402, 404, such that the concave portions are generally centered along the pouch 100.

In an example, the concave portions 406, 408 can indent at least 1 mm into the edge 402, 404 of the pouch 400. In the example shown in FIG. 4, the concave portions 406, 408 indent about 2 mm into the edge 402, 404 of the pouch 400. In an example, the concave portions can be an inward curving arc having a radius of at least 15 mm and an arc length of at least 20 mm.

In the example shown in FIG. 4, the permanent seals(s) 104 are disposed along and define the longitudinal edges 402, 404 and the third edge 418 of the pouch 400. In other examples, however, the permanent seal(s) 104 can be disposed inward from one or more of the longitudinal edges 402, 404, or the third edge 418.

In the example shown in FIG. 4, the concave portions 406, 408 consist of an inward curving arc, however, in other examples, the concave portions 406, 408 can have other shapes such as a chevron, or a flat bottomed inward projection.

FIGS. 5A, 5B, and 5C illustrate example coverage areas for sealing steps during the sealing of two walls 108, 110 to form the pouch 100. In an example, the one or more permanent seal(s) 104 are created in multiple sealing steps. FIG. 5A illustrates an example coverage area 502 of a press or ultrasonic energy for a first of the multiple sealing steps. This first sealing step creates the first portion 202 and second portion 204 of the one or more permanent seal(s) 104. The area 502 represents the area in which the press contacts the walls 108, 110 or the area in which the ultrasonic energy is applied to create the permanent seal(s) 104. As discussed above with respect to FIGS. 1A and 1B, the sealing step(s) to create the permanent seal(s) 104 can be conducted for an appropriate length of time, with an appropriate magnitude of force/energy, and at an appropriate temperature to create the permanent seal(s) 104 having the peeling force discussed above. Notably, at the intersection with the easy-peel seal 102, the inside edge of the coverage area 502 of the sealing continues in a straight line from the area defining the enclosed space through the area of the easy-peel seal 102. This straight line is the demarcation between the permanent seal(s) 104 and the easy-peel seal 102. Thus, when the easy-peel seal 102 is fully opened, the inside edge of the resulting opening forms a substantially straight line with the inside edge of the formerly enclosed space. This straight line enables the contents of the pouch 100 to flow freely out through the opening of the pouch 100.

FIG. 5B illustrates an example coverage area 504 for creating the easy-peel seal 102. The area 504 represents the area in which a press contacts the walls 108, 110 or the ultrasonic energy is applied to create the easy-peel seal 102. As discussed above with respect to FIGS. 1A and 1B, the sealing step to create the easy-peel seal 102 can be conducted for an appropriate length of time, an appropriate magnitude of force/energy, and at an appropriate temperature to create the easy-peel seal having the peeling force discussed above. Typically, the sealing step to create the easy-peel seal will be conducted for a shorter length of time, lower force/energy, and/or lower temperature than is used for the sealing step(s) to create the permanent seal(s) 104. As shown, the coverage area 504 for creating the easy-peel seal 104 overlaps the coverage area 502 to create the permanent seal(s) 104. This overlap ensures that a continuous seal is formed at the intersection of the permanent seal(s) 104 and the easy-peel seal 102.

FIG. 5C illustrates an example coverage area 506 for a second step of creating the one or more permanent seal(s) 104. This second step creates the third portion 206 of the one or more permanent seal(s) 104. The area 502 represents the area in which the press contacts the walls 108, 110 or the area in which the ultrasonic energy is applied to create the permanent seal(s) 104. As discussed above with respect to FIGS. 1A and 1B, the sealing step(s) to create the permanent seal(s) 104 can be conducted for an appropriate length of time, with an appropriate magnitude of force/energy, and at an appropriate temperature to create the permanent seal(s) 104 having the peeling force discussed above. As shown, the coverage area 506 for creating the third portion 206 of the permanent seal(s) 104 overlaps the coverage area 502 of the first portion 202 and second portion 204. This overlap ensures that a continuous seal is formed at the intersection of the respective portions 202, 204, 206.

To create a permanent seal 104 or easy-peel seal 102 having a desired shape (such as is shown herein) the sealing steps used to create the permanent seal(s) 104 and easy-peel seal 102 are conducted such that the areas in which the seal 102, 104 are contacted by the presses (or the area in which the ultrasonic energy is applied) are configured to have the desired shape of the seals 102, 104. The areas in which no seal is desired are not contacted by the presses (or no ultrasonic energy is applied). For example, a vertical press having a contact surface with the desired shape of the resulting seal (e.g., an easy-peel seal with a convex portion) can be used to contact one or both walls 108, 110 to form the resulting seal as known to those in the art.

In an example, the first sealing step of the permanent seal(s) 104 and the sealing step for the easy-peel seal 102 are performed prior to filling the pouch 100, 400 with contents. After these sealing steps, three edges of the pouch 100, 400 are sealed and one edge remains open. The contents of the pouch can then be inserted into the pouch 100, 400. After the contents are inserted into the pouch 100, 400, the second sealing step for the permanent seal(s) 104 can be performed to complete the seal around the pouch 100, 400. Leaving the third portion 206 of the permanent seal(s) 104 unsealed and using that edge to fill the pouch 100, 400 can be advantageous because this enables the easy-peel seal 102 to be created prior to filling the pouch 100, 400. Creating the easy-peel seal 102 prior to filling the pouch can be advantageous, because there is less chance of an improper seal from contamination due to the contents of the pouch. This contamination issue is less likely for the permanent seal(s) 104, since the permanent seal(s) 104 has a higher strength. Other numbers, orders, or configurations of sealing steps may also be used.

The pouches described herein can be constructed in any suitable manner. For example, the pouches can be constructed in a pre-made manner where the pouch walls are cut and assembled together with a first machine (e.g., in a first location) and the pouch is filled and finally sealed with a second machine(s) (e.g., in a second location). In other examples, the pouches can be constructed in a form, fill, and seal technique in which the pouch walls are formed (e.g., foil overlap), pockets are formed between two walls via one or more sealing steps. Once formed, the pockets can be filled with contents (e.g., pet food), and then enclosed via a second sealing step, before the pouches are cut to final shape. In many examples, the form, fill, and seal of the pouches can be performed all with a single machine.

FIG. 6 is a top view of an example sheet 600 of material from which the walls 108, 110 can be cut in order to construct a pre-made pouch. The example sheet 600 can be a sheet having the composition of the walls 108, 110. For example, sheet 600 can include polypropylene, polyester, polyethylene, polyamide and/or a bio-based/bio-degradable plastic. In many examples, the sheet 600 is a laminate (e.g., 2 ply, 3 ply, 4 ply) including at least one layer of plastic. In a particular example, the sheet 600 is a laminate including a layer of polyethylene terephthalate (PET), a layer of polypropylene, and a layer of aluminum therebetween with a Sealution™ resin on the polypropylene layer. Other examples are also possible.

FIG. 6 illustrates an example cutting pattern used to cut the walls 108, 110 from the sheet 600. In an example, at least two rows 602, 604 of walls 108, 110 are cut from a single sheet 600. In the particular implementation shown in FIG. 6, four rows 602, 604, 606, 608 of walls 108, 110 are cut from a single sheet 600. Moreover, in this example, both walls 108, 110 have a common shape, such that a single corresponding shape can be used for each cut and the resulting piece can be used for either wall 108 or wall 110. In other example, each wall 108, 110 can have a different shape and the different shapes can be cut out of a common sheet of material or out of different sheets of material. In this example, a wall 108 from a first row 602 is sealed to a wall 110 from a second row 604 in a later processing step (not shown) to form the pouch 100.

In the example shown in FIG. 6, each wall 108, 110 has a generally rectangular geometry corresponding to the geometry of the pouch 100 described above. The geometry includes a first longitudinal edge 610 and a second longitudinal edge 612 substantially parallel with the first longitudinal edge. Each wall 108, 110 also includes a third edge 614 substantially transverse to the first edge 610 and second edges 612. Similar to the geometry described above with respect to pouch 100, in the implementation shown in FIG. 6, the first edge 610, second edge 612, and third edge 614 of each wall 108, 110 are three sides of a hypothetical rectangle and the fourth side of the hypothetical rectangle is replaced with the outwardly curved fourth edge 616 which defines the flap 106.

In the example shown in FIG. 6, each wall 108, 110 in a given row 602, 604, 606, 608 is oriented the same way. Thus, each wall 108 in the first row 602 is oriented with its fourth edge (defining the flap 106) pointing in a first direction 618. Each wall 110 in the second row 604 is oriented with its fourth edge 616 pointing in a second direction 620. Notably, the walls 108 in the first row 602 are oriented with their fourth edge 616 pointing towards the second row 604 and the walls 110 in the second row 604 are oriented with their fourth edge 616 pointing towards the first row 602. That is, the first direction 618 is the opposite of the second direction 620 such that the walls 110 in the second row are rotated 180 degrees with respect to the walls 108 in the first row 602. This 180-degree rotation orients the walls 108, 110 in the adjacent rows 602, 604 with their flaps 106 pointing towards the adjacent paired row. The walls 108, 110 in the respective adjacent rows 602, 604 are offset from each other in the horizontal direction 622 such that the flaps 106 of the first row 602 extend into concave areas defined between adjacent flaps 106 of the second row 604. Likewise, the flaps 106 of the second row 604 extend into concave areas defined between adjacent flaps 106 of the first row 602. Notably, the disposition of the walls 108, 110 on the sheet 600 described herein is the pattern in which the walls 108, 110 are cut from the sheet 600. Cutting the walls 108, 110 out of the sheet 600 with the flaps 106 of the first row 602 interstitially positioned with the flaps 106 of the adjacent second row 604 reduces waste material in the sheet 600 as compared with other orientations of the walls 108. Additional pairs of adjacent rows (e.g., the third row 606 and fourth row 608) can be oriented in the same relative manner. In the example shown in FIG. 6, the second row 604 is offset from the first row 602 by half a width of a wall 108, 110, such that a centerline of the walls 108, 110 in one row 602, 604 is aligned with the edges of the walls 108, 110 in the other row 604, 602.

In the example shown in FIG. 6, each wall 108, 110 is oriented with its longitudinal edges 610, 612 perpendicular to a longitudinal dimension (aligning with the horizontal direction 622 in this example) of the sheet 600, however, other orientations are also possible. Additionally, although the walls 108, 110 having straight edges are shown in the example of FIG. 6, walls having other geometries (such as the walls of pouch 400) can also be cut out in the orientation described with respect to FIG. 6. The sheet 600 can be cut in any suitable manner such as with a rotary die, a flat die, a laser, or an air jet.

FIG. 7 is a top view of an alternative cutout pattern on a sheet 700 of material to form example walls 702, 704. Sheet 700 can have the same composition described with respect to sheet 600. In this alternative cutout pattern, each wall 702, 704 is oriented similarly to that described with respect to FIG. 6. The walls 702, 704, however, have a slightly different geometry than the walls 108, 110 described above. The first longitudinal edge, second longitudinal edge, and third longitudinal edge can be the same as that described above with respect to walls 108, 110. The flap 106 in the fourth edge, however, can have a shape configured such that a flap 106 from a first row 706 matches a concave area between flaps 106 of an adjacent second row 708. Such a shape will further reduce the wasted material of the sheet 700 during cutting.

Advantageously, the flexible packages described herein can be used to enclose a food product such as a pet food. In a particular implementation, the flexible packages can be used to enclose a "wet" food product (e.g., pet food) such as a food product having a water activity at or above 0.6.

In an example, the flexible packages described herein can have a dimension that is suitable to be held in a single hand of a consumer. Accordingly, the flexible packages can have length and width dimensions in the range of 50 to 300 mm and can be configured to hold in the range of 25 to 200 grams of "wet" food product.

What is claimed is:

1. A flexible package to contain a food product therein, comprising:

a first flexible wall;

a second flexible wall opposed to and coupled to the first flexible wall;

a plurality of outside edges, including a first edge, a second edge, a third edge, and fourth edge, wherein the flexible package is openable only along the first edge of the plurality of outside edges;

at least one permanent seal, wherein the at least one permanent seal has a strength between 20 N/15 mm and 50 N/15 mm; and one peelable seal forming the first edge, wherein the peelable seal has a strength between 7.5 N/15 mm to 15 N/15 mm;

wherein the one peelable seal is configured to have a lower effective peel force than the at least the one permanent seal, wherein the at least one permanent seal and the peelable seal define the plurality of outside edges, the peelable seal having a first elongated portion and a second elongated portion joined together at an apex, wherein an external edge of the apex of the peelable seal projects outwards from a single enclosed space;

wherein the at least one permanent seal and the peelable seal couple the first flexible wall with the second flexible wall to define the single enclosed space therebetween in a filled, sealed state and maintain an airtight seal of the single enclosed space in the filled, sealed state, the flexible package openable at the apex of the peelable seal along the first edge of the plurality of outside edges to release contents from the flexible package after opening;

wherein a first portion and a second portion of the at least one permanent seal each increases in a width dimension in a direction distal to the apex, the first portion being disposed opposite to the second portion, wherein a width of the single enclosed space decreases in the direction distal to the peelable seal, wherein the peelable seal is configured to maintain the airtight seal of the single enclosed space in the filled, sealed state through a retort process, and wherein the peelable seal further includes:

a first linear portion positioned between the first elongated portion and the first portion, wherein the first elongated portion is disposed at an angle to the first linear portion; and a second linear portion positioned between the second elongated portion and the second portion, wherein the second elongated portion is disposed at an angle to the second linear portion, wherein a coverage area of the first linear portion of the peelable seal overlaps with the first portion at a first radiused intersection and a coverage area of the second linear portion of the peelable seal overlaps with the second portion at a second radiused intersection, wherein the peelable seal extends over the second edge and the third edge in the direction distal to the apex of the peelable seal to form a continuous seal at the first and second radiused intersections of the permanent seal and the peelable seal, wherein each of the first and second flexible walls includes at least one flap extending beyond the peelable seal in a direction opposite the single enclosed space, wherein the at least one flap of each of the first and second flexible walls are pulled away from one another to peel apart the peelable seal and open the flexible package, wherein the peelable seal is configured to form an opening at the apex at an effective peel force of between 7.5 N to 15 N as the at least one flap of each of the first and second flexible walls are pulled away from one another and the effective peel force decreases as the opening of the peelable seal transitions between the first and second elongated portions and the first and second linear portions, and the effective peel force increases by at least 5 N as the opening transitions between the first and second linear portions and the first and second radiused intersections.

2. The flexible package of claim 1, wherein the plurality of outside edges define a perimeter of the single enclosed space.

3. The flexible package of claim 1, wherein each of the at least one flap of each of the first and second flexible walls comprises at least one grip feature, wherein the at least one grip feature is a chevron or arc that projects in the same direction as the apex of the peelable seal, wherein the at least one grip feature extends in a direction generally parallel to the peelable seal, wherein the at least one grip feature is raised or sunken at least 0.5 mm with respect to a main surface of each of the at least one flap of each of the first and second flexible walls.

4. The flexible package of claim 1, wherein the width dimension of the at least one permanent seal increases in width by at least 50 percent along the first portion and the second portion in the distal direction.

5. The flexible package of claim 1, wherein the width dimension of the at least one permanent seal increases in width by at least 2 mm along the first portion and the second portion in the distal direction.

6. The flexible package of claim 1, wherein the width dimension of the at least one permanent seal increases in width from a dimension less than 3.5 mm to a dimension at least 5.5 mm in the distal direction.

7. The flexible package of claim 1, further comprising a food product disposed in the single enclosed space, the food product having a water activity at or above 0.6.

8. The flexible package of claim 7, wherein the food product comprises pet food.

9. The flexible package of claim 1, wherein the first and second portions each include a concave portion disposed at a location in the range of 30 percent to 70 percent along a longitudinal length thereof, wherein the first and second concave portions are configured to impart pressure points that permit contents to exit the flexible package.

10. The flexible package of claim 1, further comprising a gusset coupled to and disposed between the first flexible wall and the second flexible wall, wherein the gusset is opposite the apex.

11. The flexible package of claim 1, wherein the first elongated portion, the second elongated portion, the first flexible wall, and the second flexible wall form a convex portion, wherein a height dimension of the convex portion is at least 2 mm with respect to the first and second linear portions.

12. The flexible package of claim 1, wherein the increase in width of the first portion and the second portion of the at least one permanent seal is configured to:

enable an outside edge associated with the first portion to be parallel to an outside edge associated with the second portion; and enable an internal edge of the first portion to be angled in relation to an internal edge of the second portion.

13. The flexible package of claim 1, wherein when the first edge is opened to permit access to the single enclosed space, the first and second radiused intersections of the permanent seal and the peelable seal are configured (a) to permit the peelable seal to fully open and unseal along the first edge and (b) to permit an inside edge of the first portion and an inside edge of the second portion to each form a straight line that is configured to permit contents within the flexible package to flow freely out through the opening of the pouch.

14. A flexible package comprising:

a first flexible wall;

a second flexible wall opposed to and coupled to the first flexible wall;

a plurality of outside edges, including a first edge, a second edge, a third edge, and fourth edge, wherein the flexible package is openable only along the first outside edge of the plurality of outside edges;

at least one permanent seal comprising a resin, wherein the at least one permanent seal has a strength of between 20 N/15 mm and 50 N/15 mm; and one peelable seal forming the first edge, wherein the peelable seal has a strength between 7.5 N/15 mm to 15 N/15 mm;

wherein the one peelable seal is configured to have a lower effective peel force than the at least the one permanent seal, wherein the at least one permanent seal and the peelable seal define the plurality of outside edges, the peelable seal comprising a resin and including two elongated portions joined together at an apex, wherein the at least one permanent seal and the peelable seal couple the first flexible wall with the second flexible wall to define a single enclosed space therebetween in a filled, sealed state and maintain an airtight seal of the single enclosed space in the filled, sealed state, the flexible package openable at the apex of the peelable seal along the first outside edge of the plurality of outside edges, wherein an external edge of the apex of the peelable seal projects outwards from the single enclosed space, wherein a first portion and a second portion of the at least one permanent seal each increases in a width dimension in a direction distal to the apex, the first portion being disposed opposite to the second portion, wherein a width of the single enclosed space decreases in the direction distal to the peelable seal;

wherein the peelable seal is configured to maintain an airtight seal for the single enclosed space through a retort process, wherein the resin of the at least one permanent seal and the resin of the peelable seal are the same, and wherein the resin of the at least one permanent seal is cured differently than the resin of the peelable seal, wherein the curing of the resin of the at least one permanent seal differs from the curing of the resin of the peelable seal in at least one of an energy, a temperature, and a duration of time, and wherein the peelable seal further includes:

a first linear portion positioned between the first elongated portion and the first portion, wherein the first elongated portion is disposed at an angle to the first linear portion; and a second linear portion positioned between the second elongated portion and the second portion, wherein the second elongated portion is disposed at an angle to the second linear portion, wherein a coverage area of the first linear portion of the peelable seal overlaps with a part of the first portion at a first radiused intersection and a coverage area of the second linear portion of the peelable seal overlaps with the second portion at a second radiused intersection, wherein the peelable seal extends over the second edge and the third edge in the direction distal to the apex of the peelable seal to form a continuous seal at the first and second radiused intersections of the permanent seal and the peelable seal, wherein each of the first and second flexible walls includes at least one flap extending beyond the peelable seal in a direction opposite the single enclosed space, wherein the at least one flap of each of the first and second flexible walls are pulled away from one another to peel apart the peelable seal and open the flexible package, wherein the peelable seal is configured to form an opening at the apex at an effective peel force of between 7.5 N to 15 N as the at least one flap of each of the first and second flexible walls are pulled away from one another and the effective peel force decreases as the opening of the peelable seal transitions between the first and second elongated portions and the first and second linear portions, and the effective peel force increases by at least 5 N as the opening transitions between the first and second linear portions and the first and second radiused intersections.

15. The flexible package of claim 14, wherein the increase in width of the first portion and the second portion of the at least one permanent seal is configured to:

enable an outside edge associated with the first portion to be parallel to an outside edge associated with the second portion; and enable an internal edge of the first portion to be angled in relation to an internal edge of the second portion.

* * * * *